US005180103A

United States Patent [19]

Harrison, Jr. et al.

[11] Patent Number: 5,180,103

[45] Date of Patent: Jan. 19, 1993

[54] SPRAY NOZZLE FLUID DISTRIBUTION SYSTEM

[75] Inventors: Richard H. Harrison, Jr., Columbia; Bryan F. Garrish, Ellicott City, both of Md.

[73] Assignee: AMSTED Industries Incorporated, Chicago, Ill.

[21] Appl. No.: 738,681

[22] Filed: Jul. 31, 1991

[51] Int. Cl.[5] ..... B05B 1/26

[52] U.S. Cl. ..... 239/1; 239/518

[58] Field of Search ..... 239/504, 518, 520, 524, 239/1

[56] References Cited

U.S. PATENT DOCUMENTS

| | | | |
|---|---|---|---|
| 1,520,125 | 12/1924 | Haas | 239/518 X |
| 1,639,162 | 8/1927 | Brooks | 239/DIG. 1 X |
| 3,981,347 | 9/1976 | Willim | 239/543 X |
| 4,058,262 | 11/1977 | Burnham . | |
| 4,208,359 | 6/1980 | Bugler, III et al. . | |
| 4,401,273 | 8/1983 | Olson | 239/543 X |
| 4,498,626 | 2/1985 | Pitchford | 239/230 |
| 4,568,022 | 2/1986 | Scrivnor . | |

FOREIGN PATENT DOCUMENTS

| | | | |
|---|---|---|---|
| 1787757 | 8/1952 | Austria | 239/518 |

OTHER PUBLICATIONS

Bete Fog Nozzle Inc. Catalog 87, pp. 54–55 and 62–63.

*Primary Examiner*—Andres Kashnikow
*Assistant Examiner*—Kevin P. Weldon
*Attorney, Agent, or Firm*—Edward J. Brosius; F. S. Gregorczyk; Thomas J. Schab

[57] ABSTRACT

A large nozzle is provided which may be used in a distribution system comprising multiple nozzles to uniformly distribute fluid to an underlying surface. The nozzle is non-clogging, operates at very low spray pressures, and evenly distributes fluid over a wide area. The nozzle comprises a main body and an underlying dual pyramid shaped deflecting means. In operation, the nozzle produces multiple uniform flat planes of fluid. When used in a distribution system comprising a plurality of nozzles, the planes of fluid from one nozzle intersect with planes of fluid from other nozzles multiple times in all directions about the nozzle to disperse the fluid. The nozzle is also provided with a flow reducing insert means and a flow directing device. A novel method of fastening the large nozzle to the header pipe is also provided.

37 Claims, 7 Drawing Sheets

SPRAY NOZZLE FLUID DISTRIBUTION SYSTEM

FIELD OF THE INVENTION

This invention relates generally to an improved spray nozzle fluid distribution system. Specifically, this invention provides a large spray nozzle which can be used in a distribution system to evenly distribute fluid to an underlying surface.

BACKGROUND OF THE INVENTION

Evaporative cooling equipment such as cooling towers, evaporative condensers, and closed circuit fluid coolers are well known in the art. Such equipment has been used for many years to reject heat to the atmosphere. Cooling towers typically operate by distributing the water to be cooled over the top of a heat transfer surface and passing the water through the heat transfer surface while contacting the water with air. As a result of this contact, a portion of the water is evaporated into the air thereby cooling the remaining water.

In closed circuit fluid coolers and evaporative condensers, the fluid to be cooled, or the refrigerant to be condensed, is contained within a plurality of closed conduits. Cooling is accomplished by distributing cooling water over the outside of the conduits while at the same time contacting the cooling water with air.

In all applications of evaporative cooling equipment, proper water distribution within the equipment is critical to efficient performance of the equipment. Uneven distribution of water to the heat transfer surface will reduce the available air-to-water interfacial surface area which is necessary for heat transfer. Severe maldistribution of water may result in air flow being blocked through those areas of the heat transfer media which are flooded with water while at the same time causing air to bypass those areas of the media which are starved of water.

Generally, water distribution systems used in evaporative cooling equipment are either of the gravity feed type or the pressure spray distribution type. Gravity feed distribution system typically comprise a basin or pan which is positioned above the heat transfer media. In the bottom of the basin are positioned nozzles which operate to gravitationally pass water contained in the basin through the bottom of the basin while breaking up the water into smaller droplets and distributing the water droplets to the underlying heat transfer surface.

Pressure spray distribution systems, on the other hand, typically comprise multiple water distribution branches, or headers, positioned above the heat transfer with each branch containing a multitude of small spray nozzles. Generally, these nozzles are arranged closely in a uniform spacing in an attempt to achieve even water distribution across the typically rectangular top of the heat transfer surface. In the past, such nozzles generally had very small openings which easily became blocked by particles entrained in the water stream. In addition, the small nozzle opening restricted the flow through the nozzle which necessitated the use of many nozzles to sufficiently pass the required volume of water.

Attempts have been made, especially in the utilization of pressure spray distribution systems, to develop nozzles which will allow for the reduction of the number of nozzles required in any given system while at the same time achieving uniform water distribution. U.S. Pat. No. 4.058,262 describes one such spray distribution system in which there is shown use of spray nozzles wherein each nozzle forms with one adjacent nozzle a cooperative pair to create a generally rectangular spray pattern. Even though it is claimed that the number of nozzles is reduced with this spray distribution system, the nozzles shown in this patent are still of a generally small size and many would be needed in a large size cooling tower. In addition, the spray pattern generated by such system is generally not uniform.

U.S. Pat. No. 4,568,022 describes another spray distribution system utilizing nozzles which emit a generally circular spray pattern. Since the nozzles described in this patent emit spray about their entire 360° perimeter, it is claimed that fewer nozzles are required. Also, this patent also describes that the sprays from one nozzle intersect with sprays from adjacent nozzles in both the length and width direction. However, the nozzles described are still of generally small size. In fact, the patent teaches that when such nozzles are used to distribute water over a cooling tower fill, such nozzles should be spaced about 8 inches apart on a given spray branch.

Although the spray distribution systems described above provide adequate water distribution in cooling towers of a relatively small to medium size, such distribution systems utilizing nozzles of a small size are not practical when used in large towers. In addition to the great number of small nozzles that would be required, even water distribution is difficult to achieve in towers of large size for several additional reasons.

In large towers, the problem of nozzle clogging is exacerbated due to the size of the tower components which allows even greater opportunity for foreign objects to find their way into the distribution system. To counteract this potential clogging problem, it is preferable on large towers to utilize nozzles with orifices as large as possible to allow them to pass most debris through the nozzle without becoming clogged. Of course, as is known in the art, the larger the nozzle orifice, the more difficult it is to achieve uniform water distribution.

Also, it is desired to keep the overall height of the evaporative cooling equipment to a minimum. This necessitates positioning the spray distribution system at a minimum distance above the top of the heat transfer surface. Unfortunately, the closer the distribution system is to the top of the heat transfer surface, the less room there is for the water to be distributed and the less surface area the spray from each nozzle is generally able to cover. This fact makes reducing the overall number of nozzles more difficult to achieve.

Additionally, in today's environment of energy consciousness, it is of critical importance to minimize the required spray water pumping pressure. Typically, pressure spray distribution systems have operated at spray pressures in the range of 3–8 psig. However, it is now desired to operate with spray pressures of no greater than 3 psig. This is especially true in very large towers where a very small increase in spray pressure required can add hundreds of thousands of dollars to the operating cost of the unit over its lifetime. Achieving uniform water distribution at low spray pressures is extremely difficult. This is due to the fact that at low spray pressures, there is very little energy available from the spray pressure to assist in spreading and distributing the water flow through the nozzles.

One method that could be used to distribute water in a large cooling tower would be to simply increase the size of the components of the distribution systems which have been successfully used on smaller towers. Unfortunately, such a simple solution will not result in uniform water distribution. If the size of a successful small distribution were increased, it would be necessary to increase all dimensions of the distribution system by a proportional amount. For example, if the nozzle opening had to be four times as large to be non-clogging, then all dimensions of the distribution system would have to be four times as great—including the height from the top of the heat transfer surface to the distribution system. Such an increase in tower height would be unacceptable.

Also, even the very good distribution system used on small towers have some areas of maldistribution. Generally these areas of maldistribution are small and do not significantly impact the performance of the tower. However, if the size of these small distribution systems were increased, the small areas of maldistribution which are acceptable on small towers will become proportionally larger and will become unacceptably large areas of maldistribution. Accordingly, it is necessary to utilize a completely different nozzle and distribution system design when providing a distribution system for a large cooling tower.

U.S. Pat. No. 4,208,359 describes a low head, non-clogging water distribution system that is intended to be used on large counterflow cooling towers. The nozzle described emits a generally hollow cone of water which is impacted upon a circular deflecting structure containing small, arcuate water-dispersing buttons. The resulting pattern produced by the nozzle is that of a full cone underneath the nozzle. The nozzle is sized to allow it to pass particles up to generally 1.5 inches in diameter. However, the fact that the nozzles of U.S. Pat. No. 4,208,359 emit a generally circular pattern limit the capability of this system to evenly distribute fluid to a rectangular area. Also, the spray cones emitted by adjacent nozzles do not interact with each other.

SUMMARY OF THE INVENTION

The present invention provides generally an improved fluid distributing nozzle which, when combined in a system comprising a plurality of such nozzles, provides even fluid distribution to an underlying surface.

The nozzle of the present invention is non-clogging and is intended to operate at spray pressures in the range of 1–3 psig, though it has operated well at pressures as low as 0.75 psig. The nozzle of the present invention is large when compared to prior art nozzles, thereby minimizing the number of nozzles required in any given application. Also, best distribution has been achieved when the spray from one nozzle is impacted by the spray of other nozzles. Accordingly, the nozzle and distribution system of the present invention have been designed to maximize the number of spray intersections.

The nozzle of the present invention generally consists of a main body having a substantially cylindrical bore therein. Four legs support a deflecting member in a vertically spaced relation under the cylindrical bore. The deflecting member is comprised of a top deflector which is in the shape of a four sided, acute angle pyramid and a bottom member which is in the shape of a frustum of a four sided obtuse angle pyramid. The top deflector is positioned on top of the bottom deflector such that the sides of the top and bottom deflector are generally aligned.

In operation, the nozzle receives fluid to be distributed and divides the fluid into four substantially equal streams by impacting the fluid upon the vertex of the top deflector. Each of the four streams is generally flattened and spread out in a 90° angle from the vertex as it passes over the top and bottom deflector. Upon leaving the bottom deflector, each stream is a flat, stable, uniform plane of fluid emanating away from the nozzle at an angle approximately 15° from horizontal. The four streams together, when viewed from above, form a pattern 360° about the nozzle.

The nozzle of the present invention is intended to be used in a distribution system whereby the fluid planes produced from one nozzle intersect fluid planes created by adjacent nozzles. In fact, a given fluid plane produced from one nozzle undergoes multiple intersections prior to the time the fluid plane impacts the underlying surface to which fluid is being distributed. At each intersection, a portion of the fluid in the plane is dispersed downward while a portion of the fluid remains in the plane to undergo further intersections. By this manner, uniform water distribution is achieved.

The present invention also comprises a nozzle insert which has a reduced diameter bore through which fluid passes. The purpose of such insert is to allow the flow rate through a given size nozzle to be easily varied in accordance with the requirements of each application.

Additionally, a flow directing means is also a part of the present invention. This device operates to direct the flow leaving the nozzle body toward one or more sides of the top deflecting pyramid. In this manner, the nozzle can be easily modified to produce fluid planes in a particular direction. Such flexibility is especially desired in distributing fluid about the perimeter of an underlying surface.

The present invention also provides a new method of fastening large nozzles to spray distribution piping. One embodiment of such method involves the use of a saddle shaped grommet which is inserted into the header piping. The nozzle of the present invention has nozzle supports about its top perimeter. When the nozzle is inserted into the grommet such that the nozzle supports overlap the top lip of the grommet, the nozzle and grommet design provide secure support which will not allow the nozzle to be pushed out of the header piping during operation. In another embodiment of this method, an adapter is glued to the header piping and the nozzle supports are fitted into a slot provided in the adaptor.

IN THE DRAWINGS

DETAILED DESCRIPTION

Figure 1:
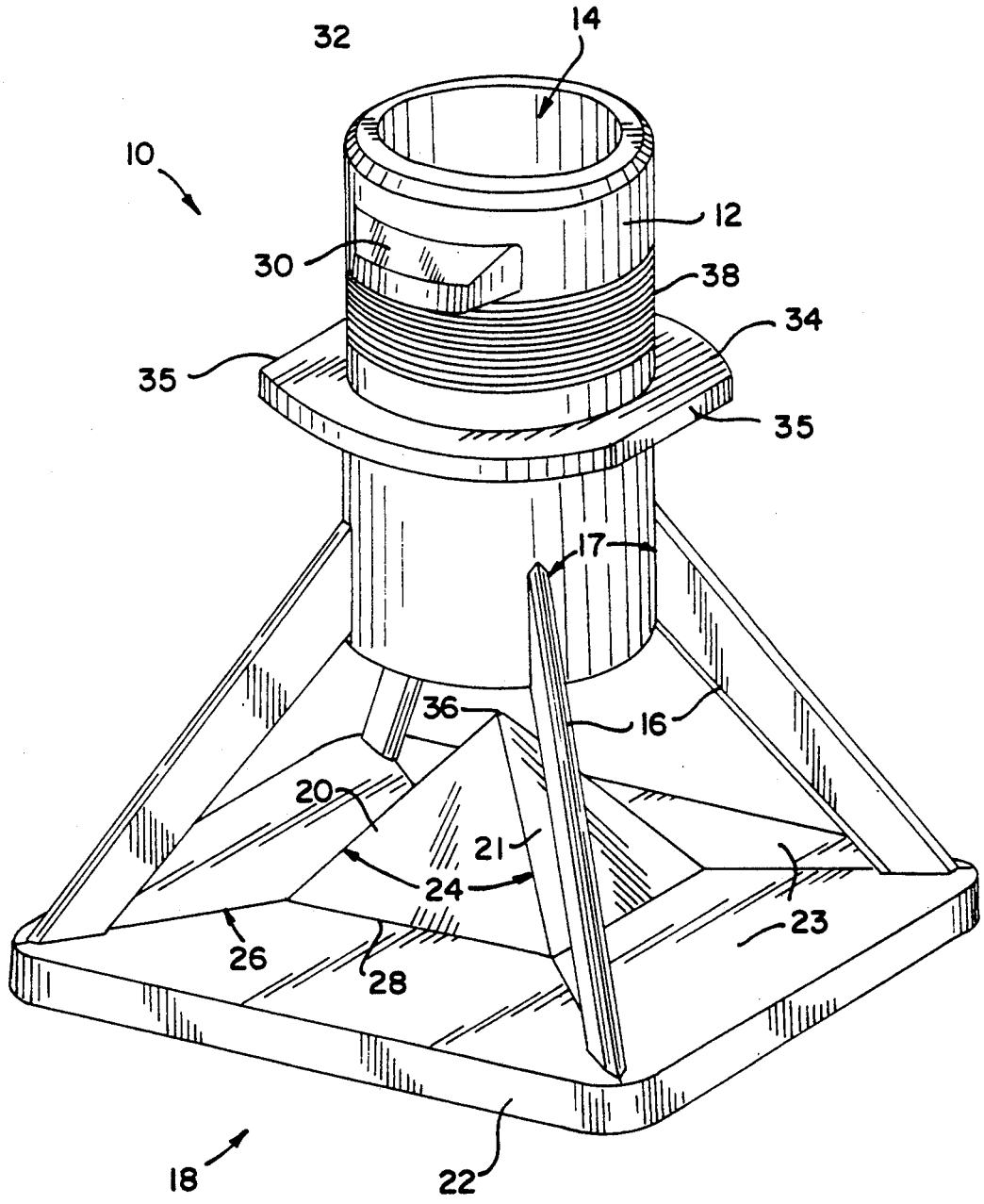
FIG. 1 is a side, isometric view of the nozzle in accordance with the invention.

Referring to FIG. 1, there is shown generally at 10 an isometric view of the nozzle of the present invention. Nozzle 10 comprises main body 12 which is of general cylindrical shape. Main body 12 includes axial bore 14 which also is generally cylindrical in shape and which passes through main body 12 to create a channel for fluid flow therethrough. Main body 12 of nozzle 10 has a top edge 32 which is rounded to promote smooth fluid entrance into axial bore 14. Grooves 38 extend about the outside circumference of main body 12 over a vertical area of approximately 0.25–1.5 inches. Grooves 38 are typically about 0.03 inches deep.

Attached to a bottom, outside edge of main body 12 at 17 are supporting legs 16 which are of an elongated, rectangular shape. Supporting legs 16 are positioned on main body 12 at 90° intervals and radiate outward and downward from each point of attachment 17 on main body 12. Supporting legs 16 attach at their opposite end to deflector shown generally as 18.

Deflector 18 is comprised of top deflector 20 and bottom deflector 22. In its preferred embodiment top deflector 20 is in the shape of an acute angle pyramid which is comprised of 4 equal triangular shaped sides 21. Each triangular side 21 is sloped at an angle of about 45° from vertical such that the top points of sides 21 form a vertex 36 at the top and center of pyramid 20. Sides 21 of top deflector 20 are joined to form edges 24. Edges 24 are generally slightly rounded to allow fluid flowing down top deflector 20 to "wrap-around" edges 24 rather than shearing off.

Although top deflector 20 is shown as an acute angle pyramid with sides being sloped approximated 45° from vertical, it is anticipated that other alternative angles could be successfully utilized. Also, it is possible that top deflector 20 could have as few as 2 sides or have greater than four sides. In addition, it is possible that top deflector 20 could be in the shape of a regular cone or in the shape of a cone with inwardley curved, concave sides.

Top deflector 20 is positioned on top of, and at the center of bottom deflector 22. Bottom deflector 22 is typically in the shape of a frustum of an obtuse angle pyramid and is comprised of 4 equal sides 23. Sides 23 of bottom deflector are trapezoidal in shape and join at their sides to form edges 26. The top of trapezoidal sides 23 are of the same length as the base of triangular sides 21 and are joined together at 28 such that edges 24 of top deflector 20 and edges 26 of bottom deflector 26 are in general alignment. Similarly to top deflector 20, bottom deflector 22 could have as few as 2 sides or have greater than four sides. Deflector 18 is attached to main body 12 via supporting legs 16 which are attached to bottom deflector 22 at a top of each corner thereof.

Whereas deflector 18 has been shown comprising top deflector 20 and bottom deflector 22, an alternative embodiment would be to utilize a deflector 18 comprising only a single deflector. Typically in such case, the single deflector will be in the general form of an obtuse angle pyramid.

Nozzle 10 also comprises two supports 30, only one of which is shown on FIG. 1. Supports 30 protrude from a top, outside edge of main body 2 and are positioned 180° apart. Supports 30 function to hold nozzle 10 in place in spray pressure piping during operation. Supports 30 are typically of a curvilinear shape and are about 0.125 to 0.25 inches in height, protrude approximately 0.125 to 0.375 inches away from main body 12, and have a length which is generally about 0.25–0.375 inches, following the circumference of main body 12.

Nozzle 10 also comprises shoulder 34 which is positioned at about mid-length of main body 12. Shoulder 34 is typically an annular ring with two diametrically opposite flat sides 35. Flat sides 35 are located radially about main body 12 such that they are 90° transposed from supports 30. This is done to provide a means for properly aligning supports 30 within the spray pressure piping in which nozzle 10 is used. Shoulder 34 typically protrudes from main body 12 about 0.375–0.75 inches and is about 0.125–0.25 inches in thickness. Shoulder 34 continues about the entire circumference of main body 12.

Nozzle 10 is generally molded in a single piece out of polypropylene, though it is possible that other materials could be utilized. Also, nozzle 10 could be molded in multiple components which would then be assembled.

Figure 2:
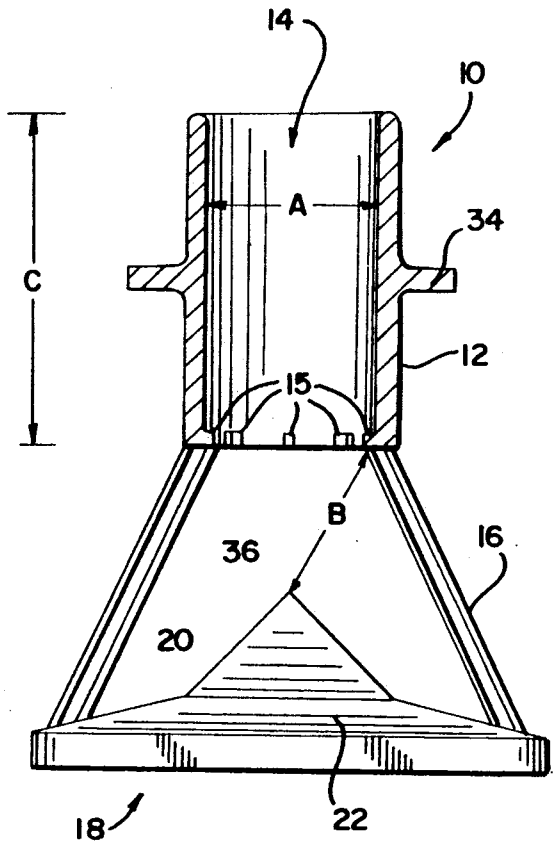
FIG. 2 is a side cross-sectional view of the nozzle in accordance with the present invention.

Referring now to FIG. 2 there is shown generally at 10 a side view of the nozzle of the present invention. Note that identical reference numerals are used on FIG. 2 and FIG. 3 to refer to the same components as were shown in FIG. 1. As described previously, nozzle 10 comprises main body 12 having axial bore 14 and comprises supporting legs 16 and deflector shown generally as 18. Main body 12 also comprises support knobs 15 which are typically about 0.125 inches in height and width and with a thickness of about 0.060 inches. Support knobs 15 are spaced equidistantly about the inside of axial bore 14 at a bottom side thereof.

The diameter of axial bore 14 is shown as "A" and is typically in the range of 0.25–3 inches. This diameter is considerably larger than has been used previously in the art and provides a nonclogging passageway through which a large volume of fluid may pass.

Diameter A generally will be used to determine the length of main body 12 which is shown as "C". It has been learned that the ratio of length to diameter of axial bore 14, that is the ratio of C to A, is critical to achieving acceptable flow distribution from nozzle 10. Typically, the length to diameter ratio must be at least 1.5 and preferably is 2.0 or greater. Accordingly, axial bore diameters of 0.25–3 inches will necessitate using a axial bore length preferably of 0.5–6 inches, though the axial bore length could be as short as 0.375 inches.

Diameter A will also be used to determine the distance that deflector 18 will be spaced underneath main body 12. In order to provide a non-clogging nozzle, it is necessary to provide a large, clear passageway for fluid flow throughout the entire nozzle. Thus, to eliminate the possibility that a particle may pass through axial bore 14 and become lodged at some other location of the nozzle, deflector 18 is positioned below main body 12 such that the distance between vertex 36 and an inside, bottom edge of main body 12 will be at least equal to diameter A. As a result, any particle which passes through axial bore 14 will be able to pass through the entire nozzle without becoming lodged therein.

Figure 3:
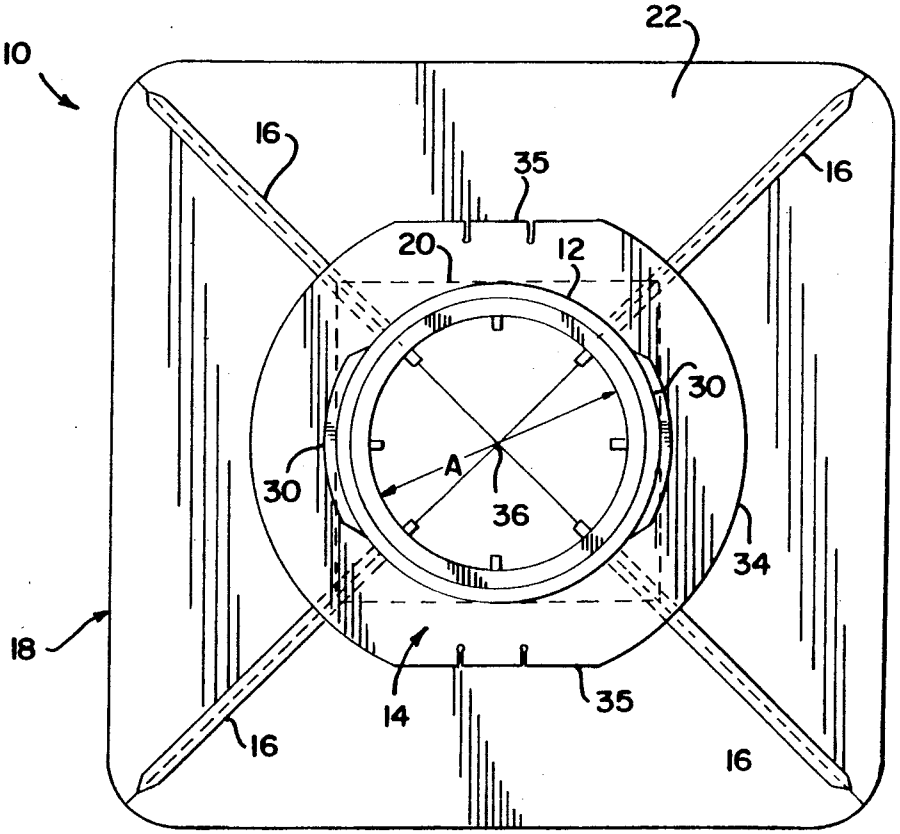
FIG. 3 is a top, plan view of the nozzle in accordance with the invention.

Referring now to FIG. 3, there is shown a plan view of nozzle 10 of the present invention. Again, note that nozzle 10 is comprised of main body 12 having axial bore 14 therein, supporting legs 16 and deflector shown generally as 18. From this drawing, it is evident that flat sides 35 of shoulder 34 are generally positioned 90° transposed from supports 30.

Also, an important feature of nozzle 10 is that the base of top deflector 20 is at least as wide as is diameter A of axial bore 14. The result from this feature is that all fluid flowing downward through axial bore 14 first impacts a surface which is at a substantial vertical angle. Accordingly, this allows for a smooth turning of the fluid from a substantially vertical direction to a direction having a significant horizontal vector component without creating excessive splash or splatter which otherwise occurs when a vertical stream impacts a substantially horizontal surface.

FIG. 3 also shows that vertex 36 is centrally located underneath axial bore 14. Accordingly, fluid flowing downwardly through axial bore 14 is divided into 4 substantially equal streams.

Referring again to FIG. 1, the operation of the nozzle in accordance with the present invention will be explained. It is anticipated that nozzle 10 could be utilized an any number of applications where it is desired to evenly distribute fluid to an underlying surface. For example, a typical application where nozzle 10 of the present invention will be utilized is in the distribution system of a water cooling tower.

Generally in such a cooling tower application, the nozzle would be affixed to a water distributing header, though it could also be utilized in a gravity feed basin. In each case, water would generally approach nozzle 10 from a horizontal direction and would turn downward and flow into axial bore 14. In flowing downward through axial bore 14, the fluid flow is smoothed and stabilized due to the sufficient length of axial bore provided. Accordingly, by the time the fluid has passed through axial bore 14, the fluid stream is in the form of a free jet flowing substantially vertically downward.

Upon exiting axial bore 14, the free jet of fluid enters the atmosphere and continues to flow vertically downward whereupon it impacts vertex 36 of top deflector 20. Upon impacting vertex 36, the fluid stream is divided into four equal streams, each of which is turned approximately 45° from the vertical direction in flowing down sides 21 of top deflector 20. Also, as fluid streams are flowing down sides 21, the fluid spreads out to cover the entire surface area of side 21. As previously stated, it is possible that different forms of pyramids or conical deflectors could be used such that the fluid would be divided in either less than or greater than four streams, depending upon the particular application.

When the fluid streams reach the bottom of top deflector 20, the direction of fluid stream flow is again changed due to the impact of the streams with sides 23 of bottom deflector 22. In impacting sides 23, the fluid streams are typically turned about an additional 30° towards horizontal such that the streams are flowing at an angle of about 15° from horizontal. In flowing over sides 23, the fluid streams spread out to cover substantially the entire surface of sides 23 causing the streams to flatten into planes of fluid. Upon leaving sides 23 of bottom deflector 22, the streams of fluid are relatively flat, stable planes of fluid flowing at a direction of about 15° from horizontal. When utilizing a four sided pyramid of the preferred embodiment, the planes of fluid generally fan out in a horizontal direction from an angle of 90° such that flow is created around the nozzle in 360° direction. Note that if an alternative deflector were used, it would be possible to vary the flow direction and coverage such that streams of either less than or greater than a 90° fan shape may be created. Such streams may or may not cover the entire 360° area about the nozzle. For example, two 120° fan shape planes may be created, among others. In all cases, the fluid planes have substantially uniform fluid flow across their width.

It is important that the water entering axial bore 14 does so in a smooth manner to prevent turbulence or the induction of air into the flow stream. Accordingly, main body 12 is provided with a rounded inlet 32 into axial bore 14. If, instead, inlet 32 was "squared-off", there would be the possibility of creating a venturi contracti such that an area of low pressure within the nozzle would be formed. This low pressure area would cause air to flow into the fluid flow stream within axial bore 14. Once within axial bore 14, the air would become pressurized. Upon exiting the axial bore 14 into the lower pressure atmosphere, the air entrained within the exiting fluid would expand and cause excessive splatter upon impacting top deflector 20. If this were to occur, the planes of fluid formed by the nozzle would not be as uniform, stable or flat as preferably desired.

Figure 4:
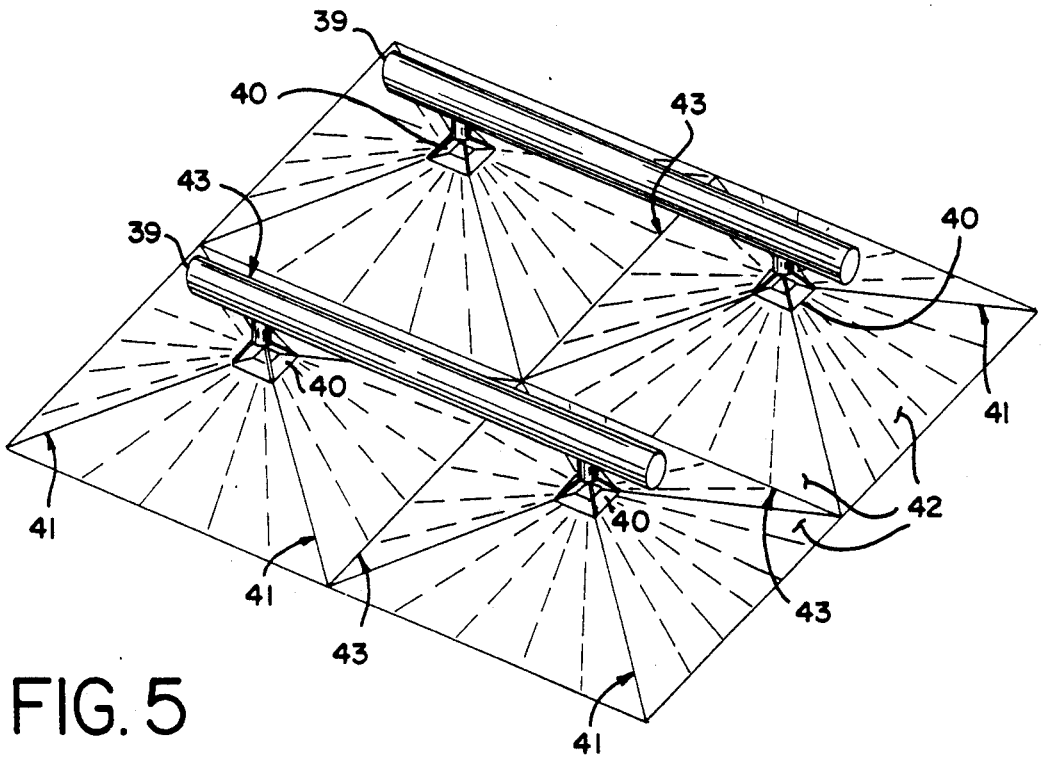
FIG. 4 is a isometric view of a header and nozzle arrangement in accordance with the present invention to illustrate the spray patterns generated by the nozzles.

As shown on FIG. 4, the nozzles of the present invention are typically utilized in a spray distribution system containing multiple nozzles. Shown on this figure are four nozzles 40 of the present invention affixed to two fluid headers 39. Typically, nozzles 40 are spaced approximately 12–48 inches apart on a header 39 with the fluid headers being generally parallel to each other and spaced approximately 12–48 inches apart from their centerlines. This spacing is much larger than typically is used in pressure spray distribution systems. Fluid headers 39 are generally placed approximately 8–36 inches above the surface to which fluid is being distributed which is similar to the spacing typically used in pressure spray distribution systems.

As can be seen from FIG. 4, nozzles 40 each produce four uniform flat planes of fluid 42 spreading out in a 90° fan shape away from nozzles 40 and sloped at an angle of about 15° from horizontal. Each of flat planes 42 are bounded by edges 41. The resulting fluid planes form a pattern 360° about each nozzle.

One reason for the uniform distribution achieved with the nozzle and distribution system of the present invention results from the fact that fluid planes 42 produced from a given nozzle intersect fluid planes produced by adjacent nozzles in all directions. These intersections are shown as 43 on FIG. 4. The action of intersecting with other planes produces a dispersion of fluid underneath the plane. Although the action of impacting the sprays from one nozzle with the sprays from another nozzle is not new, the nozzles of the present invention improve upon the distribution obtained by such action through the creation and intersection of refined, uniform, stable flat planes of fluid.

In prior art intersecting spray systems, the planes of fluid which were intersected were not stable, flat, or uniform. Accordingly the fluid distribution resulting from the intersections was poor. This is particularly true where such prior art systems were operated at spray pressures less than 3 psig.

In the present invention when two of the flat planes of fluid are intersected, the resulting fluid distribution underneath the intersection is more uniform than has previously been obtained with other intersecting type nozzles. In addition, the feature of intersecting in all four directions provides uniform fluid dispersion in the direction along the axis of the header pipes as well as between adjacent pipes. Also, the nozzle of the present invention provides uniform planes of fluid at low spray pressures of 0.75–3.0 psig.

Since fluid planes 42 are flat, the intersections between fluid planes 42 will be relatively straight, horizontal lines and are shown as 43. In the application when nozzles 40 are spaced evenly apart in all four directions, the intersections when viewed from above will form a square about the nozzle. If the nozzles on a given branch were spaced closer together than the headers were spaced apart, the intersections when viewed from above would form a rectangular pattern about the nozzle. In this fashion, flexibility of fitting the spray pattern to the surface to which fluid is being distributed may be achieved.

Another feature of the present invention which greatly assists in providing uniform fluid distribution utilizing large nozzles is the fact that any given plane of fluid emanating from a nozzle undergoes multiple intersections with other planes of fluid prior to the time the fluid reaches the surface to which it is being distributed. This feature is illustrated in FIG. 5 where there is shown a side view of a single header distribution system in operation.

Figure 5:
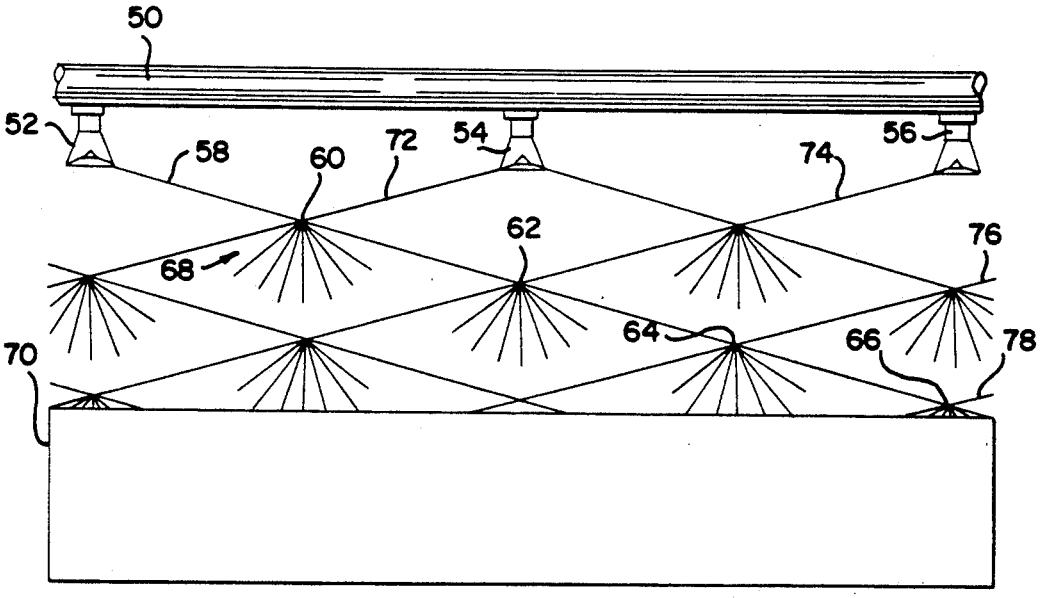
FIG. 5 is a side view of a header and nozzle arrangement in accordance with the present invention illustrating the fluid plane intersections created by the arrangement.

In FIG. 5, nozzles 52, 54, and 56 are affixed to spray header 50. Each of nozzles 52, 54, and 56 are in operation and are producing four uniform planes of fluid, though only two planes per nozzle are shown. The distribution system is operational to provide fluid uniformly to underlying surface 70, which in an evaporative cooling device would be a heat transfer surface typically comprised of either a plurality of fill sheets, fluid conduits, or other heat transfer surface.

Focusing on fluid plane 58 which is produced from nozzle 52, it is seen that this plane undergoes four separate intersections with fluid planes of other nozzles which are aligned on header 50 prior to the time the remainder of fluid plane 58 strikes underlying surface 70. Specifically, fluid plane 58 first intersects at 60 fluid plane 72 produced by nozzle 54. At this intersection, a portion of fluid contained in fluid planes 58 and 72 is dispersed downward in a fan type pattern while the remaining fluid remains in the plane.

The remaining fluid in plane 58, after passing through intersection 60, then intersects for a second time at 62 with fluid plane 74 produced from nozzle 56. Like fluid plane 58, fluid plane 74 has also undergone one previous intersection prior to its intersection with fluid plane 58. Again, at intersection 62, a portion of fluid in fluid planes 58 and 74 is dispersed downward in 10 a fan pattern while the remaining fluid remains in the plane and passes through intersection 62.

After passing through intersection 62, fluid plane 58 then intersects for a third time at 64 with fluid plane 76 which is produced by a nozzle not shown on the figure. As before, a portion of the fluid in these planes is dispersed while the remaining fluid passes through the intersection. After passing through intersection 64, the remaining fluid still in plane 58 intersects for a fourth time at 68 with fluid plane 78 which is again produced by a nozzle not shown on the figure.

By this method of creating multiple intersections between fluid planes of separate nozzles, in some cases between separate nozzles which are substantially removed from each other, it is possible to provide uniform fluid distribution over the entire surface 70. Although FIG. 5 shows only those intersections of fluid planes produced from nozzles on the same header pipe, similar intersections occur between planes of fluid from nozzles on separate headers in both a perpendicular and diagonal direction.

Figure 6:
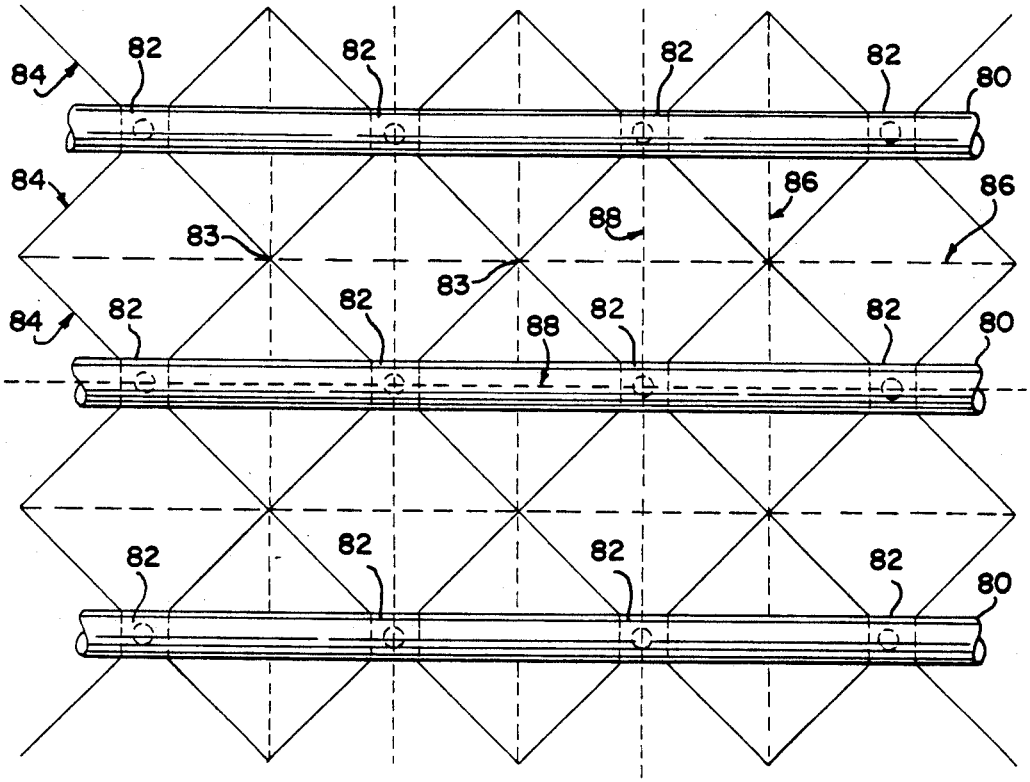
FIG. 6 is a plan view of a header and nozzle arrangement in accordance with the present invention illustrating the spray pattern generated and the locations of the primary and secondary intersections produced.

Referring now to FIG. 6, there is shown a plan view of the spray patterns, including primary and secondary intersections, produced by a distribution system utilizing the nozzle of the present invention. Shown on FIG. 6 are three spray headers 80 to which nozzles 82 are affixed in a uniform pattern. Four nozzles are shown affixed to each spray header 80. Solid lines represent the side boundaries 84 of the flat planes of fluid produced by each nozzle 82. As can be seen, each nozzle 82 produces four uniform planes of fluid, each plane of fluid being of generally a fan shape spreading horizontally outward away from nozzles 82 at an angle of about 90°.

Dashed lines show the primary intersections 86 created by the fluid planes produced from one nozzle impacting for the first time with fluid planes produced from adjacent nozzles. Primary Intersections 86 produce a square pattern around each nozzle 82 when viewed from above. Dotted lines show the secondary intersections 88 created by the fluid planes produced from one nozzle impacting for a second time with fluid planes produced from other nozzles. Secondary intersections 88 occur underneath nozzles 82 and effectively divide the square pattern created by primary intersections 86 into four equal smaller squares.

Although they are not shown on FIG. 6, tertiary intersections would occur below the primary intersections in the same vertical plane and quaternary intersections would occur below the secondary intersections in the same vertical plane. When it is remembered that underneath each of these intersections the fluid within the plane is being dispersed, it is clearly seen that the nozzle distribution of the present invention provides very uniform fluid distribution.

Figure 7:
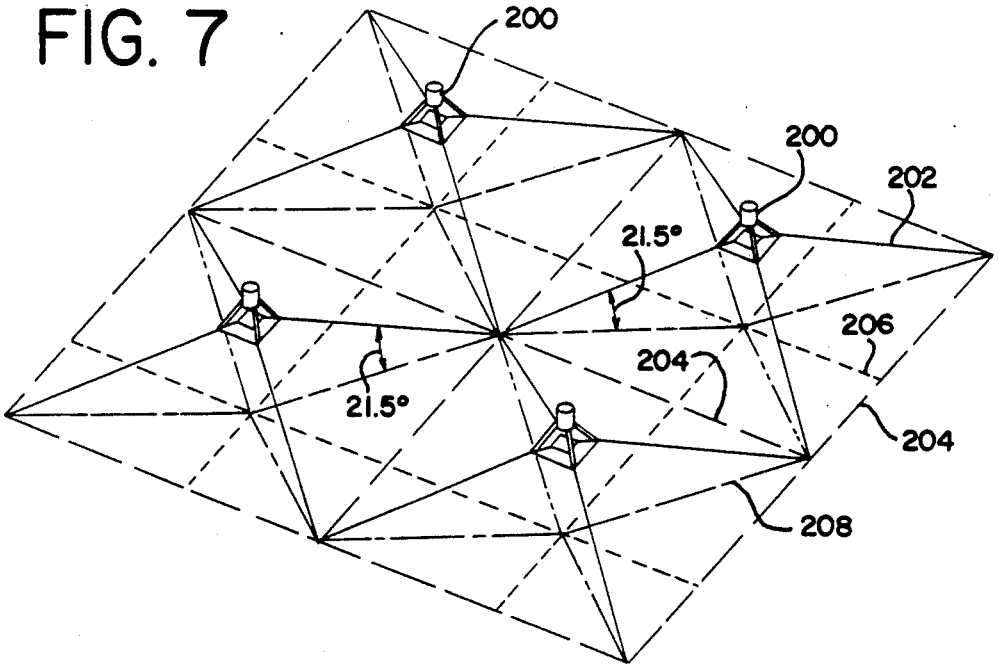
FIG. 7 is an isometric view of a header and nozzle arrangement in accordance with the present showing the locations of diagonal intersections produced.

In addition to the fluid planes from one nozzle impacting with fluid planes from nozzles which are located on the same header pipe and from nozzles which are located in a perpendicular direction on separate header pipes, a further feature of the present invention is that the fluid planes from one nozzle intersect fluid planes from other nozzles which are in a diagonal direction from each other. Referring now to FIG. 7, an isometric view of a distribution system of the present invention is shown. On this figure, nozzles 200 are each operating to produce four uniform planes of fluid bounded by sides 202, shown as solid lines. Primary intersections 204 between fluid planes are shown as dashed lines and secondary intersections 206 between fluid planes are shown as dotted lines. Note that primary intersections 204 lie in a horizontal plane above secondary intersections 206.

Also shown on this figure are diagonal intersections 208, which are shown as an alternating dotted and dashed line. Diagonal intersections 208 are intersections of fluid planes formed by nozzles which are in a diagonal relation to each other. Diagonal intersections 208 are relatively straight lines which, when viewed from above, would lie directly below sides 202 of fluid planes. Like sides 202, the diagonal intersections are not flat but are sloped at an angle about 10.7° from horizontal. One end of diagonal intersection 208 is located at the horizontal plane at the primary intersections while the other end of diagonal intersections 208 is located at the horizontal plane created by the secondary intersections. The vertical angle created by diagonal intersections 208 and sides 202 is about 21.5°.

As stated previously, the nozzle of the present invention is of a relatively large size. In fact, when operating with a spray pressure of 2 psig with an axial bore of 2 inches, each nozzle will distribute approximately 162 gpm. When utilized on very large towers, this large volume of flow through the nozzle is necessary in order to minimize the number of nozzles required. However, in certain circumstances, it will be desired to provide a nozzle with a smaller volumetric capacity.

Figure 8:
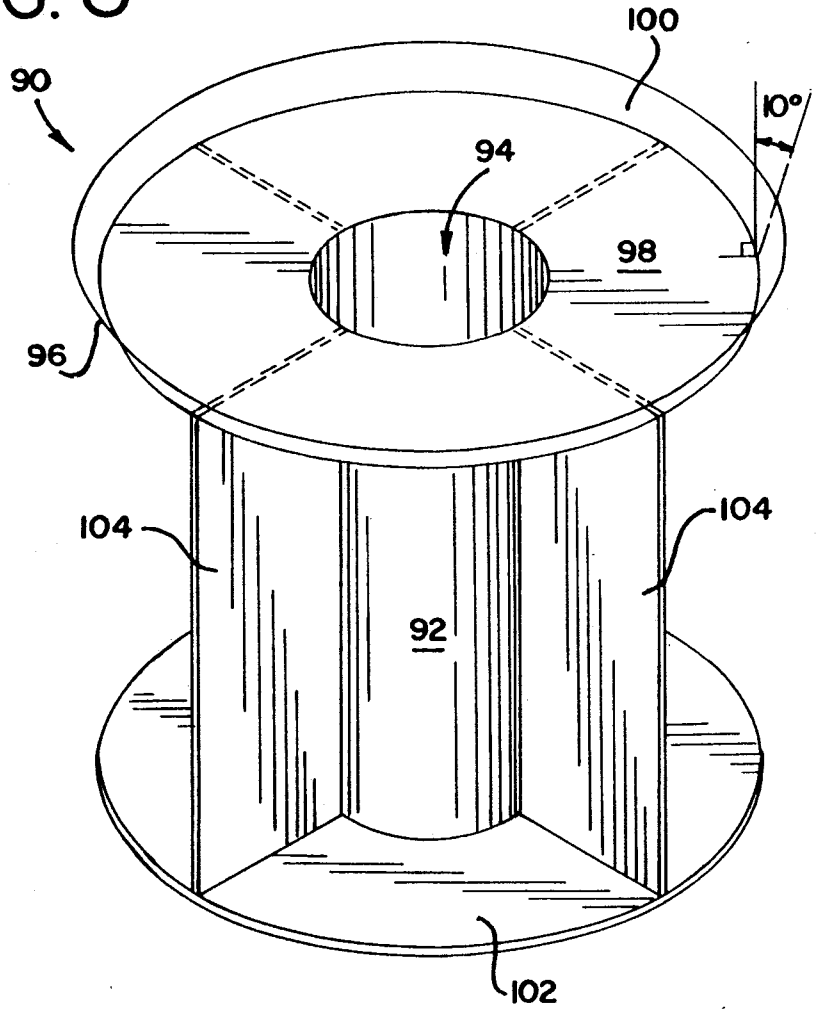
FIG. 8 is an isometric view of the flow reducing insert of the present invention.

One way to provide the nozzle of the present invention with smaller volumetric capacity would be to manufacture a nozzle with a different axial bore diameter. However, this approach would require manufacturing many different size nozzles which is costly and difficult to manage. Accordingly, shown on FIG. 8 generally at 90 is a nozzle insert which is intended to be used to reduce the volumetric capacity of the nozzle of the present invention. Nozzle insert 90 is comprised of thin-walled, cylindrical body 92 having axial bore 94 therein. Top plate 96 is connected to the top of body 92 and is comprised of annular disk 98 and side wall 100. Side wall 100 is generally tapered at its upper edge away from the center of top plate 96 at an angle of about 10°.

Nozzle insert 90 also comprises a bottom annular disk 102 located at the bottom of body 92. Extending between the bottom side of top plate 96 and the top side of bottom annular disk 102 are four equivalent spacing webs 104. Spacing webs 104 are spaced equidistant about the perimeter of body 92 and are aligned parallel with the longitudinal axis of body 92. Nozzle insert 90 is generally molded in one piece using polypropylene or other similar material.

Figure 9:
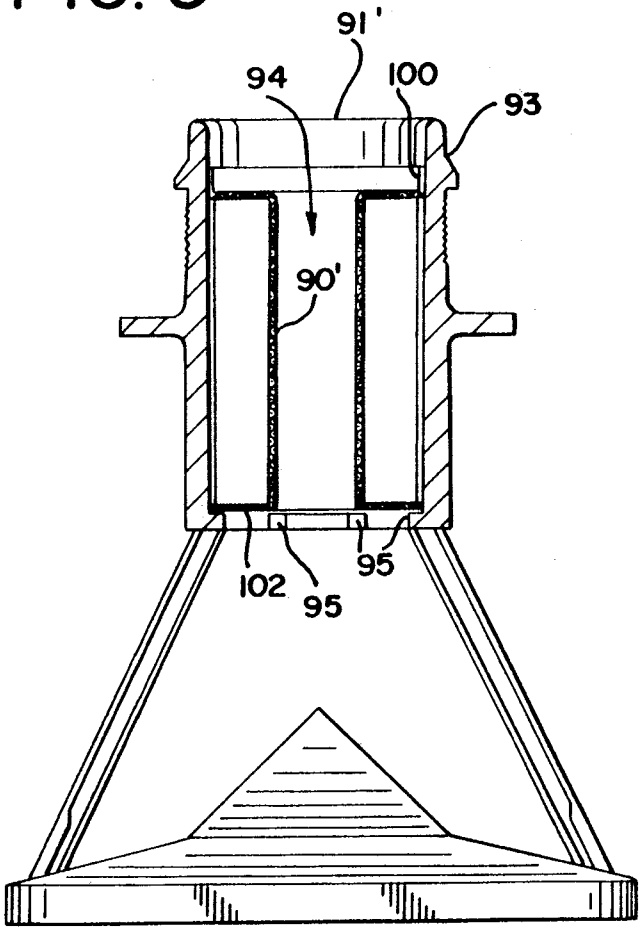
FIG. 9 is a side cross-sectional view of the nozzle and flow reducing insert assembly.

As shown in FIG. 9, nozzle insert 90' is intended to fit inside axial bore 91' of nozzle 93' such that bottom annular disk 102' rests upon support knobs 95' to hold nozzle insert 90' within axial bore 91'. In addition, side wall 100' fits firmly within axial bore 91' to prevent substantial fluid flow from bypassing axial bore 94' of insert 90'.

Axial bore 94' of nozzle insert 90' has a smaller diameter than does axial bore 91' of nozzle 93'. Accordingly, the volumetric capacity for fluid flow through nozzle insert 90' will be less than would otherwise be the volumetric capacity of nozzle 93'. In addition, axial bore 94' of nozzle insert 90' may be of many different diameters thereby providing significant volumetric capacity flexibility with only a single size nozzle.

As stated previously, the nozzle of the present invention, in its preferred embodiment, is intended to provide fluid spray about all four sides of the nozzle. In certain instances, it may be desired to limit the number of directions from which fluid spray will emanate from a given nozzle. This may especially be true of nozzles used to distribute fluid to the perimeter of a surface. In these cases, it is preferable that the nozzle not spray toward the perimeter as there will be no adjacent nozzle in that direction producing fluid spray and, thus, no intersections will be created. Accordingly, the present invention also comprises a flow director device which is shown generally at 110 on FIG. 10.

Flow director 110 comprises a thin-walled, asymmetrical conical frustum having circular inlet 114 at a top side thereof, circular outlet 118 at a bottom side thereof, and axial bore 115 extending from inlet 114 to outlet 118. Lip 116 extends about the circumference of top side of flow deflector 110. Flow director 110 has one sloped side 112 and has one vertical side 113. Inlet 114 is typically larger than outlet 118. Flow director 110 is generally molded in a single piece assembly using polypropylene, though other similar plastic materials could also be used.

Figure 10:
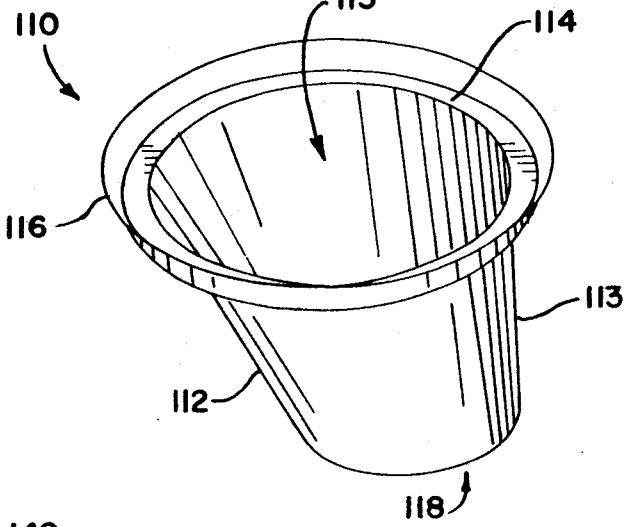
FIG. 10 is an isometric view of the flow director of the present invention.

Although flow director 110 could be used by itself with the nozzle of the present invention, flow director 110 is typically used in conjunction with the previously described nozzle insert to direct a reduced volumetric flow through the nozzle toward one or more sides of the nozzle of the present invention. Shown generally at 120 on FIG. 10 is a side cross-sectional view of nozzle 122 of the present invention utilizing nozzle insert 124 and flow director 126.

Figure 11:
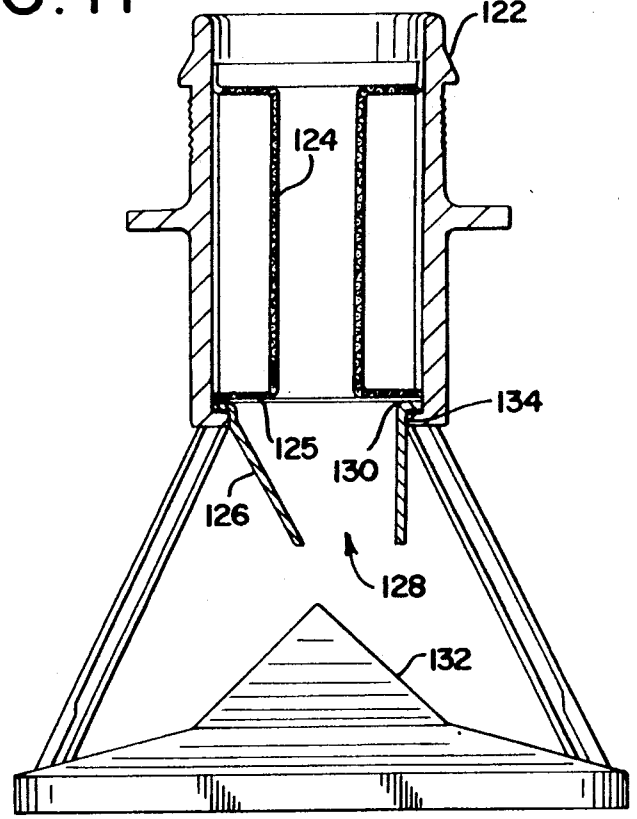
FIG. 11 is a side cross-sectional view of the nozzle, flow reducing insert, and flow director assembly of the present invention.

In FIG. 11, it is shown that flow director 126 fits down inside nozzle 122 such that top lip 130 is supported by the previously described support knobs 134. Outlet 128 of flow director 126 is directed at one side of top deflector 132. Nozzle insert 124 also fits down inside nozzle 122 such that bottom edge 125 of nozzle insert 124 rests upon top lip 130 of flow director 126. In operation, fluid would flow through the inside of nozzle insert 124, and would be directed by flow director 126 toward only one half of top deflector 132. As a result, the distribution from nozzle 122 would be limited to approximately 180° about the nozzle when viewed from above.

As stated previously, the nozzle of the present invention is large and has a much greater volumetric capacity when compared to prior art nozzles. Accordingly, the force placed upon the nozzle by the fluid passing through and being deflected by the nozzle is also much greater than that encountered by previous prior art nozzles, especially when the nozzle of the present invention is used in a pressure spray distribution system. Further, there may be instances where the spray pressure to which a nozzle is exposed is significantly greater than normal operating pressure due to upset or abnormal operating conditions. As a result, a necessary feature of the nozzle of the present invention is an improved method of fastening the nozzle to the header pipe to prevent the nozzle from being dislodged from the pipe during operation. This feature is important because, in a cooling tower application, nozzles which become displaced during operation can cause damage to the underlying heat transfer surface necessitating extensive and costly repairs.

Figure 12:
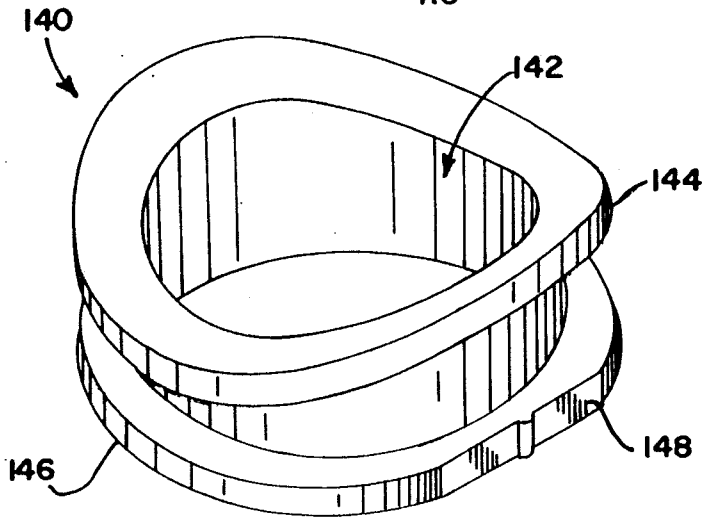
FIG. 12 is an isometric view of the saddle grommet in accordance with the present invention.

Referring now to FIG. 12, there is shown generally at 140 an improved grommet which is to be used in a preferred embodiment of a fastening method of the present invention. Grommet 140 is generally of a thin-walled cylindrical shape with axial bore 142. The inside diameter of axial bore 142 is typically approximately equal to the outside diameter of the nozzle of the present invention. Grommet 140 also comprises a saddle shaped top edge 144 which is designed to fit the inside curvature of a 6 inch pipe. Bottom edge 146 is generally flat. Both top edge 144 and bottom edge 146 extend around the circumference and radially outward of grommet 140. Grommet 140 is typically molded in one piece utilizing either an isoprene or neoprene rubber material having a durometer in the range of 40 to 70, though other similarly flexible materials could be used.

Figure 13:
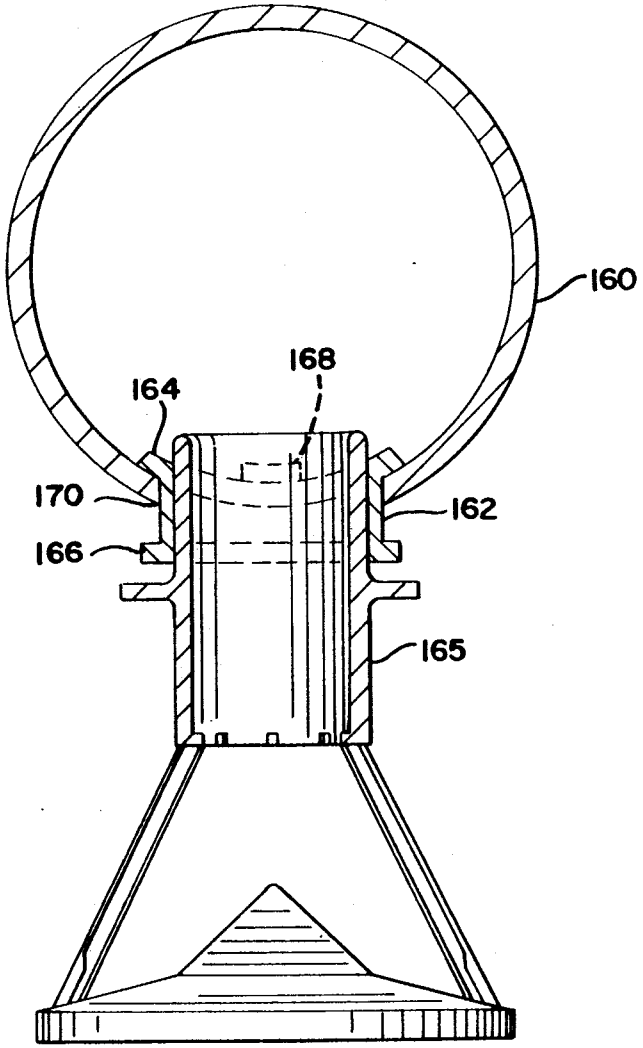
FIG. 13 is a side view showing the assembly of the nozzle and grommet of the present invention in a header pipe.

FIG. 13 is side cross-sectional view of a nozzle and spray header assembly utilizing the improved grommet and fastening method of the present invention. Typically, grommet 162 is inserted into a hole formed into header pipe 160. Note that both top edge 164 and bottom edge 166 of grommet 162 are shown in their entirety in dashed line form. Top edge 164 of grommet 162 fits inside pipe 160 such that top edge 164 rests upon and follows the contour of the inside of pipe 160. Bottom edge 166 remains outside of pipe 160. Top edge 164 is generally formed to match the contour of a 6 inch diameter pipe. However, it has been found that a grommet with such a contour will also work successfully in pipes with diameters ranging from 4–24 inches. As a result, a single grommet will satisfy fastening requirements for header pipe within this diameter range.

Nozzle 165 is inserted into grommet 162 with supports 168, also shown in dashed line form, being in a position perpendicular to the longitudinal axis of pipe 160. Once nozzle 164 has been inserted far enough into grommet 164 such that supports 168 extend past top edge 164 of grommet 162, nozzle 165 is turned about 90° to align supports 168 with the longitudinal axis of pipe 160. Typically, about 20 pounds of force is required for this insertion. Nozzle 165 is then pulled downward until supports 168 rest upon top edge 164 of grommet 162. Grooves 170 of nozzle 165 impress into the side wall of flexible grommet 162 to provide additional support and sealing. Once in place, supports 168 act in conjunction with grooves 170 to hold nozzle 165 in place in pipe 160 at forces approaching 200 pounds. As a result, the ratio of holding force to insertion force is about 10 to 1 (200 lb/20 lb).

Figure 14:
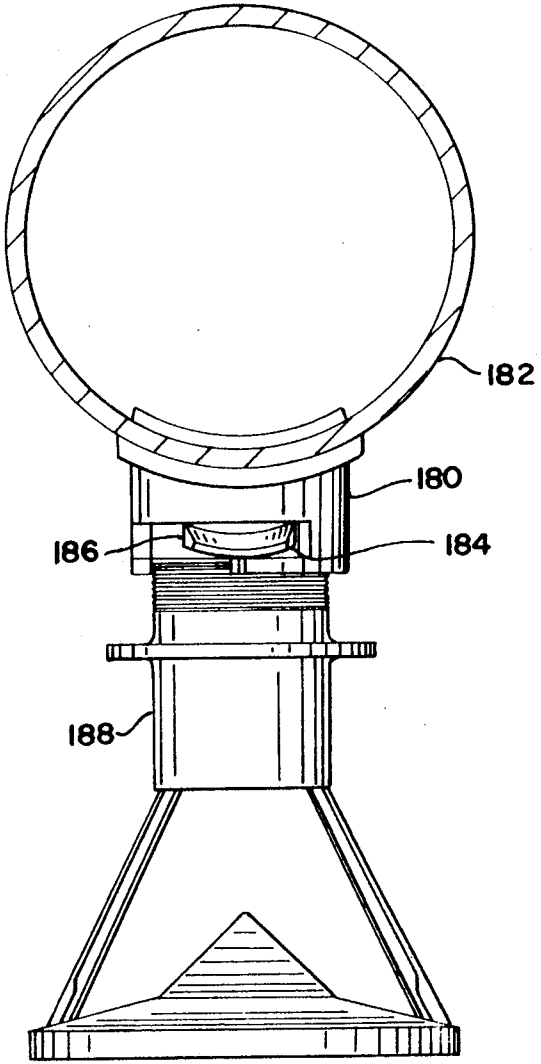
FIG. 14 is a side view showing the assembly of nozzle and adaptor of the present invention in a header pipe.

Another embodiment of a fastening method in accordance with the present invention is shown in FIG. 14. In this embodiment, adaptor 180 is glued or otherwise permanently fixed to header pipe 182. Adaptor 180 has notches 184 into which fit supports 186 of nozzle 188. Notches 184 are configured such that supports 186 may be pushed up into notches 184 and then, after nozzle 188 is turned about ⅛ of a turn, supports 186 lock into place in adaptor 180.

The foregoing description has been provided to clearly define and completely describe the present invention. Various modifications may be made without departing from the scope and spirit of the invention which is defined in the following claims.

We claim:

1. A fluid distribution device comprising:

a main body having a longitudinal axis and a wall with a wall thickness, said wall defining a generally circular and axial throughbore, said axial throughbore defining an inlet and outlet of said main body;

a fluid stream deflector comprising a top member and a bottom member, each of said top and bottom members having a top and bottom face, said top face of said top member having a plurality of sloping sides which form a centrally located vertex, said vertex centrally located below said axial throughbore of said main body outlet, said bottom member top face having a plurality of sides in the shape of a frustrum of an obtuse angle pyramid with said top member of said deflector centered on said frustrum of said bottom member; and means for supporting said deflector in a vertically spaced relation from said main body.

2. The device of claim 1 wherein said top member is in the form of a regular cone or non-straight sided cone.

3. The device of claim 1 wherein said top member is in the form of an acute angle pyramid having multiple sides and edges, said vertex being formed by said sides of top member, and said sides of top member and said sides of bottom member being in general alignment.

4. The device of claim 1 wherein said inlet of said main body is rounded to provide smooth fluid entrance into said axial throughbore.

5. The device of claim 3 wherein said top member on said fluid stream deflector has edges that are slightly rounded.

6. The device of claim 1 wherein said supporting means comprises a plurality of substantially identical legs having two ends, said legs being positioned equidistant around the outside of said main body with one end of said legs being connectable to said main body and a second end of said legs being connectable to said bottom member of said deflecting means,

7. The device of claim 1 wherein said top member of said deflector has a base, said base having a width which is greater than said axial throughbore diameter.

8. The device of claim 3 wherein said sides of said top member are triangular and are sloped at an angle ranging from 20° to 75° from vertical.

9. The device of claim 8 wherein said sides are sloped at an angle of about 45° from vertical.

10. The device of claim 1 wherein said bottom member of said deflecting device has four sides which are sloped at an angle ranging from 5° to 25° from horizontal.

11. The device of claim 10 wherein said bottom member of said deflecting device has four sides which are each sloped at an angle of about 15° from horizontal.

12. The device of claim 1 further comprising flow reducing means comprising a thin-walled cylindrical insert having an axial bore which is less than the axial bore of said main body, a top annular plate, a bottom annular plate, and spacing means protruding outward from the outside of said insert.

13. The device of claim 12 wherein said insert is of approximately the same length as said main body, said top annular plate having an outside diameter approximately equal to said axial bore diameter, and whereby said insert is placed within said axial bore of said main body to effectively reduce the cross-sectional area for flow through the axial bore.

14. The device of claim 13 further comprising a flow directional attachment comprising a hollow, asymmetrical conical frustum operable to direct fluid flow through said insert to one or more sides of said deflecting means.

15. The device of claim 1 wherein said main body further comprises a plurality of grooves extending about the outside circumference of said main body.

16. The device of claim 1 wherein the longitudinal extent of said main body is at least 1.5 times that of said diameter of said throughbore.

17. The device of claim 1 wherein said vertex on said top member of said flow stream deflector is longitudinally positioned below said main body outlet a distance of at least one throughbore diameter.

18. The device of claim 16 wherein said axial throughbore diameter of said main body is between 0.25 inches to 3 inches and said longitudinal extent of said main body is between 1.5 inches to 6 inches.

19. A method of distributing a fluid stream comprising the steps of:

forming a relatively flat, uniform, stable first plane of fluid, intersecting said first fluid plane with a separate second fluid plane, thereby causing a generally uniform dispersion of fluid underneath said intersecting first and second fluid planes; and further intersecting said first fluid plane with a plurality of separate fluid planes such that said first fluid plane undergoes a plurality of intersections prior to said first fluid plane reaching the surface to which said fluid stream is being distributed.

20. The method of claim 19 comprising the further step of forming said first fluid plane by passing a fluid stream through a hollow cylinder, then passing said fluid stream out of said hollow cylinder and into the atmosphere, then turning said fluid stream between 15°-75° and flattening the shape of said fluid stream by contacting said fluid stream with a first deflector.

21. The method of claim 20 comprising the further steps of turning said fluid stream about an additional 15°-45° and further flattening the shape of the fluid stream by contacting said fluid stream with a second deflector having a straight bottom edge positioned perpendicular to the direction of fluid flow.

22. The method of claim 21 further comprising the step of passing said fluid stream in a generally horizontal direction and turning said fluid stream 90° downward into said hollow cylinder in a substantially vertical direction prior to passing said fluid stream through said hollow cylinder.

23. The method of claim 22 comprising the further step of dividing said fluid stream into a plurality of fluid streams upon impacting said fluid stream with said first deflector, each stream becoming a flat plane of fluid.

24. The method of claim 23 wherein said first deflector has a plurality of sides, said sides joining at a top of said first deflector to form a centrally located vertex, and wherein said second deflector has a plurality of sides, said first deflector is centrally located at a top side of said second deflector such that said sides of first and second deflectors are in general alignment, said first and second deflectors being positioned such that said vertex is centrally located underneath said hollow cylinder.

25. The method of claim 24 wherein said first deflector is in the shape of a pyramid, said second deflector is the shape of a frustum of a pyramid, said second deflector having a top width equivalent to said base width of said first deflector.

26. The method of claim 25 wherein said first and second deflectors are operable to produce a plurality of uniform flat planes of fluid.

27. A fluid distribution system comprising a plurality of fluid distribution nozzles, each nozzle consisting of a main body and a fluid stream deflector, said main body having a longitudinal axis and a wall with a wall thickness, said wall defining a generally cylindrical axial throughbore, and said fluid stream deflector comprising a top member and a bottom member, each of said top and bottom members having a top and bottom face, said top face having a plurality of sloping sides which form a centrally located vertex, said vertex centered and supported in a vertically spaced relation underneath said axial throughbore of said main body, said bottom member top face having a plurality of sides in the shape of a frustrum of an obtuse angle pyramid with said top member of said deflector centered on said top side of said bottom member, said nozzles arranged in a spaced horizontal relation from each other and above a surface over which fluid is to be distributed, each nozzle being operable to produce at least one uniform, flat plane of fluid, each of said fluid planes intersecting with an adjacent nozzle fluid plane to create a dispersion of fluid underneath said intersecting fluid planes, each of said fluid planes intersecting the fluid planes of adjacent nozzles a plurality of times prior to said fluid planes reaching said surface to which said fluid is to be distributed.

28. The system of claim 27 wherein said top deflector is in the shape of a cone.

29. The system of claim 27 wherein said top deflector is in the shape of an acute pyramid having multiple equal sides, said sides are joinable at a top side thereof to form a centrally located vertex, and wherein said top deflector is positioned on said bottom deflector such that said sides of top deflector and said sides of said bottom deflector are generally aligned.

30. The distribution system of claim 27 wherein said system is operable to receive a fluid and to pass said fluid through said nozzles, each of said nozzles being operable to produce a plurality of generally flat fluid planes, each of said fluid planes having a uniform quantity of fluid flow across said planes and each of said planes emanating away from said nozzles in a direction about 5° to 25° from horizontal and spreading out radially from said nozzles at an angle of about 30°-180°.

31. The distribution system of claim 29 wherein said top deflector has four equal sides and wherein said bottom deflector has four equal sides, whereby each of said nozzles produce four planes of fluid, each of said planes emanating away from said nozzles in a direction of about 15° from horizontal and spreading out radially from said nozzles at an angle of about 90° such that a single nozzle effectively distributes fluid over a 360° pattern.

32. The distribution system of claim 30 whereby said fluid planes produced by a first nozzle intersect fluid planes produced from separate nozzles, said separate nozzles being spaced from said first nozzles in directions which are parallel to said header pipe, perpendicular to said header pipe, and diagonal to said header pipe.

33. The distribution system of claim 27 whereby said nozzles are spaced apart in the range of 8 inches to 48 inches.

34. The distribution system of claim 33 whereby said spacing between nozzles on the same header is different from the spacing between nozzles on different headers.

35. The distribution system of claim 27 whereby said nozzles are positioned approximately 8-36 inches above the surface to which fluid is distributed.

36. The distribution system of claim 27 whereby said nozzles are connectable to receive fluid to be distributed from pressure piping and whereby said fluid within said piping is at a pressure ranging from 0.75 psi-8 psi.

37. The distribution system of claim 27 whereby said nozzles are connectable to a gravity feed basin to receive fluid therefrom.

* * * * *